US007478773B2

(12) United States Patent
Gingras et al.

(10) Patent No.: US 7,478,773 B2
(45) Date of Patent: Jan. 20, 2009

(54) TOOTH REFINER PLATES HAVING V-SHAPED TEETH AND REFINING METHOD

(75) Inventors: Luc Gingras, Lake Oswego, OR (US); Mike Bacich, Portland, OR (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 11/357,026

(22) Filed: Feb. 21, 2006

(65) Prior Publication Data

US 2007/0158482 A1 Jul. 12, 2007

Related U.S. Application Data

(60) Provisional application No. 60/743,106, filed on Jan. 9, 2006.

(51) Int. Cl.
*B02C 7/04* (2006.01)

(52) U.S. Cl. ..... 241/298; 241/261.3

(58) Field of Classification Search ..... 241/296, 241/297, 298, 261.2, 261.3
See application file for complete search history.

(56) References Cited

U.S. PATENT DOCUMENTS

| | | | | | |
|---|---|---|---|---|---|
| 962,807 | A * | 6/1910 | Alsted | 241/251 |
| 1,244,513 | A * | 10/1917 | Letz | 241/296 |
| 1,244,516 | A * | 10/1917 | Letz | 241/296 |
| 1,493,785 | A * | 5/1924 | Letz | 241/296 |
| 2,791,503 | A | 5/1957 | Lyon et al. | |
| 4,269,362 | A | 5/1981 | Berggren | |
| 6,196,284 | B1 * | 3/2001 | Lequin | 144/163 |
| 6,402,071 | B1 * | 6/2002 | Gingras | 241/261.2 |

FOREIGN PATENT DOCUMENTS

| | | |
|---|---|---|
| EP | 1 147 806 | 10/2001 |
| FR | 1 160 851 | 11/1956 |
| WO | WO 99/54046 | 10/1999 |

* cited by examiner

*Primary Examiner*—Faye Francis
(74) *Attorney, Agent, or Firm*—Nixon & Vanderhye P.C.

(57) ABSTRACT

A refiner plate including a generally planar surface having annular rows of teeth arranged concentrically on the plate, and at least one of said rows includes teeth including a leading edge corner angle of less than 90 degrees. These teeth may include a leading sidewall having a radially outward portion slanted in a direction opposing the rotation of the plate.

19 Claims, 5 Drawing Sheets

TOOTH REFINER PLATES HAVING V-SHAPED TEETH AND REFINING METHOD

This application claims the benefit of U.S. Provisional Patent Application No. 60/743,106 filed Jan. 9, 2006, the entirety of which is incorporated herein by reference.

BACKGROUND

This invention relates generally to refiners for removing contaminants from fiber materials, such as recycled or recovered paper and packaging materials. In particular, the present invention relates to teeth on refiner plates and especially to the leading sidewall surfaces and leading edges of such teeth.

Refiner plates are used for imparting mechanical work on fibrous material. Refiner plates having teeth (in contrast to plates having bars) are typically used in refiners which role is to deflake, disperge or mix fibrous materials with or without addition of chemicals. The refiner plates disclosed herein are generally applicable to all toothed plates for dispergers specifically and refiners in general.

Disperging is primarily used in de-inking systems to recover used paper and board for reuse as raw material for producing new paper or board. Disperging is used to detach ink from fiber, disperse and reduce ink and dirt particles to a favorable size for downstream removal, and reduce particles to sizes below visible detection. The disperger is also used to break down stickies, coating particles and wax (collectively referred to as "particles") that are often in the fibrous material fed to refiner. The particles are removed from the fibers by the disperger, become entrained in a suspension of fibrous material and liquid flowing through the refiner and are removed from the suspension as the particles float or are washed out of the suspension. In addition, the disperger may be used to mechanically treat fibers to retain or improve fiber strength and mix bleaching chemicals with fibrous pulp.

There are typically two types of mechanical dispergers used on recycled fibrous material: kneeders and rotating discs. This disclosure focuses on disc-typed disperger plates that have toothed refiner plates. Disc-type dispergers are similar to pulp and chip refiners. A refiner disc typically has mounted thereon an annular plate or an array of plate segments arranged as a circular disc. In a disc-type disperger, pulp is fed to the center of the refiner using a feed screw and moves peripherally through the disperging zone, which is a gap between the rotating (rotor) disk and stationary (stator) disk, and the pulp is ejected from the disperging zone at the periphery of the discs.

The general configuration of a disc-type disperger is two circular discs facing each other with one disc (rotor) being rotated at speeds usually up to 1800 ppm, and potentially higher speeds. The other disc is stationary (stator). Alternatively, both discs may rotate in opposite directions.

On the face of each disc is mounted a plate having teeth (also referred to as pyramids) mounted in tangential rows. A plate may be a single annular plate or an annular array of plate segments mounted on a disc. Each row of teeth is typically at a common radius from the center of the disc. The rows of rotor and stator teeth interleave when the rotor and stator discs are opposite each other in the refiner or disperger. The rows of rotor and stator teeth intersect a plane in the disperging zone that is between the discs. Channels are formed between the interleaved rows of teeth. The channels define the disperging zone between the discs.

The fibrous pulp flows alternatively between rotor and stator teeth as the pulp moves through successive rows of rotor and stator teeth. The pulp moves from the center inlet of the disc to a peripheral outlet at the outer circumference of the discs. As fibers pass from rotor teeth to stator teeth and vice-versa, the fibers are impacted as the rows of rotor teeth rotate between rows of stator teeth. The clearance between rotor and stator teeth is typically on the order of 1 to 12 mm (millimeters). The fibers are not cut by the impacts of the teeth, but are severely and alternately flexed. The impacts received by the fiber break the ink and toner particles off of the fiber and into smaller particles, and break the stickie particles off of the fibers.

Two types of plates are commonly used in disc-type dispergers: (1) a pyramidal design (also referred to as a tooth design) having an intermeshing toothed pattern, and (2) a refiner bar design. A novel pyramidal tooth design has been developed for a refiner plate and is disclosed herein.

FIGS. 1*a*, 1*b* and 1*c* show an exemplary pyramidal plate segment having a conventional tooth pattern. An enhanced exemplary pyramidal toothed plate segment is shown in commonly-owned U.S. Patent Application Publication No. 2005/0194482, entitled "Grooved Pyramid Disperger Plate." For pyramidal plates, fiber stock is forced radially through small channels created between the teeth on opposite plates, as shown in FIG. 1*c*. Pulp fibers experience high shear, e.g., impacts, in their passage through dispergers caused by intense fiber-to-fiber and fiber-to-plate friction.

With reference to FIGS. 1*a*, 1*b* and 1*c*, the refiner or disperger 10 comprises disperger plates 14, 15 which are each securable to the face of one of the opposing disperger discs 12, 13. The discs 12, 13, only portions of which are shown in FIG. 1*c*, each have a center axis 19 about which they rotate, radii 32 and substantially circular peripheries.

A plate may or may not be segmented. A segmented plate is an annular array of plate segments typically mounted on a disperger disc. A non-segmented plate is a single piece, annular plate. Plate segment 14 is for the rotor disc 12 and plate segment 15 is for the stator disc 13. The rotor plate segments 14 are attached to the face of rotor disc 12 in an annular array to form a plate. The segments may be fastened to the disc by any convenient or conventional manner, such as by bolts (not shown) passing through bores 17. The disperger plate segments 14, 15 are arranged side-by-side to form plates attached to the face of the each disc 12, 13.

Each disperger plate segment 14, 15 has an inner edge 22 towards the center 19 of its attached disc and an outer edge 24 near the periphery of its disc. Each plate segment 14, 15 has, on its substrate face concentric rows 26 of pyramids or teeth 28. The rotation of the rotor disc 12 and its plate segments 14 apply a centrifugal force to the refined material, e.g., fibers, that cause the material to move radially outward from the inner edge 22 to the outer edge 24 of the plates. The refined material predominantly move through the disperging zone channels 30 formed between adjacent teeth 28 of the opposing plate segments 14, 15. The refined material flows radially out from the disperging zone into a casing 31 of the refiner 10.

The concentric rows 26 are each at a common radial distance (see radii 32) from the disc center 19 and arranged to intermesh so as to allow the rotor and stator teeth 28 to intersect the plane between the discs. Fiber passing from the center of the stator to the periphery of the discs receive impacts as the rotor teeth 28 pass close to the stator teeth 28. The channel clearance between the rotor teeth 28 and the stator teeth 28 is on the order of 1 to 12 mm so that the fibers are not cut or pinched, but are severely and alternately flexed as they pass in the channels between the teeth on the rotor disc 12 and the teeth on the stator disc 13. Flexing the fiber breaks the ink and toner particles on the fibers into smaller particles and breaks off the stickie particles on the fibers.

FIGS. 2*a* and 2*b* show a top view and a side perspective view, respectively, of a standard tooth geometry 34 used in disperging. The tooth 34 has a pyramidal design including strait sidewalls 36 that taper to the top 38 of the tooth. The sidewalls are planar and flat. The sidewalls of the conventional tooth are each substantially parallel to a radius of the plate.

A primary role of the disperger plate is to transfer energy pulses (impacts) to the fibers during their passage through the channels between the discs. The widely accepted toothed plate has generally incorporated the square pyramidal tooth geometry with variations in edge length and tooth placement to achieve desired results.

Refiner material passing through the channels on the plates can erode teeth. Each tooth has a leading edge that faces the pulp flow resulting from the rotation of the rotor plate. The leading edge is formed by the intersection of the front tooth surface and a leading tooth sidewall. The tooth sidewalls are planar, i.e., flat, on conventional teeth. Further, the corner of the sidewall and front surface of a conventional tooth is typically 90°. The leading edges of the teeth wear and become rounded due to the erosion.

Disperger plates are replaced typically because their teeth become rounded and lose their efficiency for disperging or refining the pulp and lose the ability to feed the pulp through the refining or disperging zone. The rounding of the teeth often results in taking the disperger or refiner offline to replace plate segments. This reduces the efficiency of the disperger and refiner. There is a long felt demand for teeth designs that extend the life of plate segments and reduce the wear on teeth.

SUMMARY

A toothed refiner plate has been developed having teeth with a leading sidewall, wherein the surface of the sidewall on the radially innermost part of the tooth forms an angle with the surface of the leading sidewall on the radially outermost part of the tooth. This angle in the leading sidewall may be formed by a V-shaped sidewall surface, a curvilinear sidewall surface, or other sidewall surface that yields an angle between the radially inward portion of the surface and the radially outward portion of the surface.

The angle between the radially inward portion of the sidewall surface and the radially outward portion may be in a range of 170 degrees to 75 degrees, and preferably in a range of 165 degrees to 90 degrees. Further, the angle in the sidewall surface results in portions of the sidewall surface forming angles with respect to a radial line of the plate. Preferably, the portions of the sidewall surface form an angle in a range of 0 degrees to 60 degrees with respect to a radial line, and preferably in a range of 5 degrees to 45 degrees.

A refiner plate is disclosed comprising: a generally planar surface having annular rows of teeth arranged concentrically on the plate, and at least one of said rows includes teeth having a leading edge corner angle of less than 90 degrees. The leading edge corner is formed by a front surface of each tooth and the leading sidewall of the tooth. The interior angle between the leading sidewall and the front surface is the leading edge corner angle. The leading sidewall faces the direction of plate rotation. The front tooth surface may be substantially tangential to its row on the plate.

The leading sidewall (at least the radially inward portion of the sidewall adjacent the leading corner) forms an angle of 0° to 60° with respect to a radial of the plate and may be in a narrow angular range of 5° to 45°. The leading sidewall may also have a radially outward portion slanted in a direction opposing the rotation of the plate. Further, the leading sidewall may form a V-shape in which a radially inward surface has an edge forming the leading edge corner. The angle of the V-shape may be in a range of 170° to 75° and more narrowly in a range of 165° to 90°.

The trailing sidewall of the tooth (which is opposite to the leading sidewall) may be symmetrical to the leading sidewall, e.g., includes a V-shape, such that a gap between the trailing side wall and the leading sidewall of the adjacent tooth is substantially constant across the length of the two teeth. Further, the radially outer row of the teeth may include teeth having rear walls normal to a substrate of the plate and front walls that slope upward from the substrate.

In another embodiment, the disperger plate may comprise: rows of teeth wherein the rows are concentrically arranged; the teeth each include a leading sidewall facing a rotational direction of the plate or of another plate rotating with respect to the plate, and the leading sidewall comprises a V-shape having a radially inner section with a leading edge and a radially outward section slanted with respect to a radial of the disc in a direction opposing the disc rotation. The angle of the V-shape is in a range of 170° to 75° and may be in a narrower range of 165° to 120°. The leading edge may be formed by an intersection of a front surface of the tooth and the leading sidewall, wherein an angle between the front surface and leading sidewall is in a range of 0° to 60° or in a narrower range of 5° to 45°.

A method has been developed of refining pulp material with opposing discs comprising: feeding the pulp material to an inlet of at least one of the discs, wherein the inlet is at or near a center axis inlet; rotating one disc with respect to the other disc while pulp material is moved between the discs due to centrifugal force; refining the pulp material by subjecting the material to impacts caused by the rows of teeth on the rotating disc intermeshing with the rows of teeth on the other disc, wherein refining further includes feeding the pulp into successive rows of teeth on the discs, wherein at least one of the rows on at least one of the discs includes teeth having a leading edge corner formed by a front tooth surface and a leading sidewall having an angle therebetween of less than 90 degrees. The method may further include deflecting pulp passing through the at least one of the rows on the at least one of the discs with a radial outward surface of the leading sidewall that is slanted in a direction opposing the rotation of at the disc. Further, the leading sidewall may form a V-shape wherein a radially inward edge of the sidewall is the leading edge corner.

BRIEF DESCRIPTION OF THE DRAWINGS

FIG. 1(*c*) is a side partially cross-sectional view of a stator and rotor disperger plates with a gap therebetween.

DETAILED DESCRIPTION

A novel arrangement of teeth for toothed refiner plates has been developed in which the teeth have sidewalls that are angled to form a V-shape. The V-shaped teeth have a double-angled geometry. In particular, the surface of at least a leading sidewall of a tooth has an inner portion that forms an angle with respect to a radially outward portion. The V-shaped can be applied to the teeth of plate segments for any type of disperger and refiner plate segments with teeth. The V-shaped sidewalls can be applied to teeth located on either or both the rotor and stator plate portions of a disperger or refiner. In a preferred embodiment, both the rotor and stator plate segments include teeth with V-shaped sidewalls.

Figure 3A:
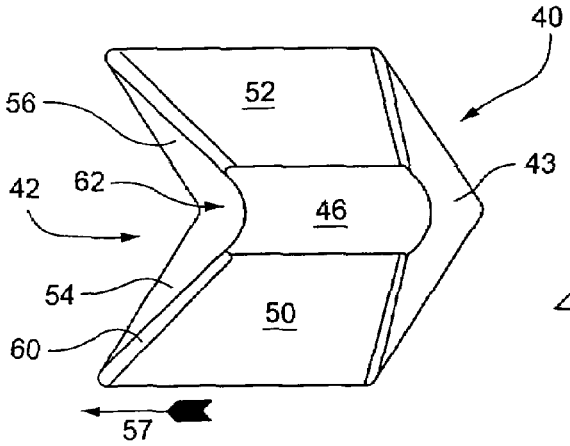
FIGS. 3*a* and 3*b* are a top down view and a side perspective view, respectively, of an angled tooth for a disperger plate segment.
Figure 3B:
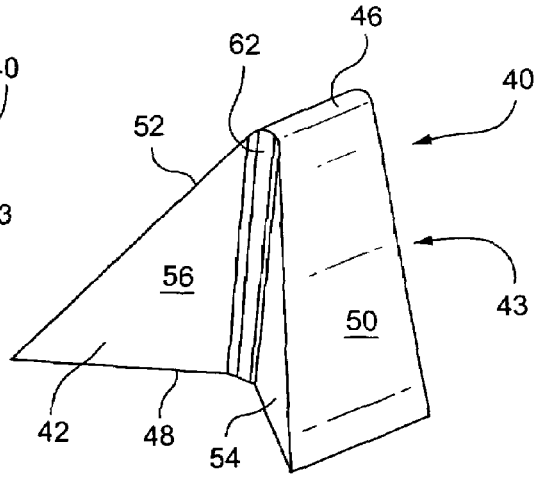

FIGS. 3*a* and 3*b* show a top view and a side perspective view, respectively, of an angled stator tooth 40 where the sides of the tooth are angled to form a V-shape. At least the leading sidewall 42 of the tooth 40 has a V-shape geometry. The trailing sidewall 43 may have a V-shape. While the sidewalls 42, 43 as shown taper towards the top 46 of the tooth, it is not necessary that the teeth are tapered from the substrate to their top and it may be preferable that there be no taper from the substrate to the top. The base 48 of the tooth is at the substrate of the plate. The front wall 50 of the tooth faces radially inward and the rear wall 52 of the tooth faces radially outward. The front and rear walls may each be substantially perpendicular to a radial of the plate. The front and rear walls may also slope towards the top of the tooth.

Each V-shape tooth has a leading sidewall 42 that faces the pulp flow resulting from the rotation of the rotor plate. The leading sidewall has an inner surface 54 that is radially inward of an outer surface 56. The inner and outer surfaces of the leading sidewall are not planar and together form a V-angle that is preferably in a range of 170° to 75°, and more preferably in the range of 165° to 120°. The angle of the V-shaped leading wall 42 is selected depending on disperging and feeding needs. The opposite (trailing) sidewall 43 preferably also has an inverted V-shape that forms a complementary angle to the leading sidewall, such as an angle of from 190° to 285°. A row of teeth with complementary leading and trailing sidewalls may have constant width gaps between the teeth.

Alternatively, the trailing sidewall may have a sidewall with a convex profile, e.g. a continually curved bulging profile, and have complementary angles to the angles of a convex (continually curved with a bowel profile) profile leading sidewall. A row of teeth having a concave leading sidewall and convex trailing sidewall (in which the angles of the leading and trailing sidewalls are complementary) may have constant width gaps between the teeth in the row.

The trailing sidewall 43 may or may not have a similar surface geometry to the leading sidewall 42. The surface profile of the leading sidewall need not be complementary to the surface profile of the trailing sidewall. For example, the trailing sidewall may be entirely planar and straight. Further, a concave surface profile on both leading and trailing sidewalls of all teeth allows a plate to perform equally in both directions of rotation and provides for a reversible plate.

Further, the V-shaped leading sidewall may have a curved cup shape from the leading edge to a radially outward edge. The angle of the sidewall should change by at least 10° from the leading edge to the radially outward edge. Further, the V-shaped sidewall teeth may be confirmed to one or a few rows of teeth on the rotor or stator plates, or may be on all teeth rows in the rotor or stator plates.

Figure 1A:
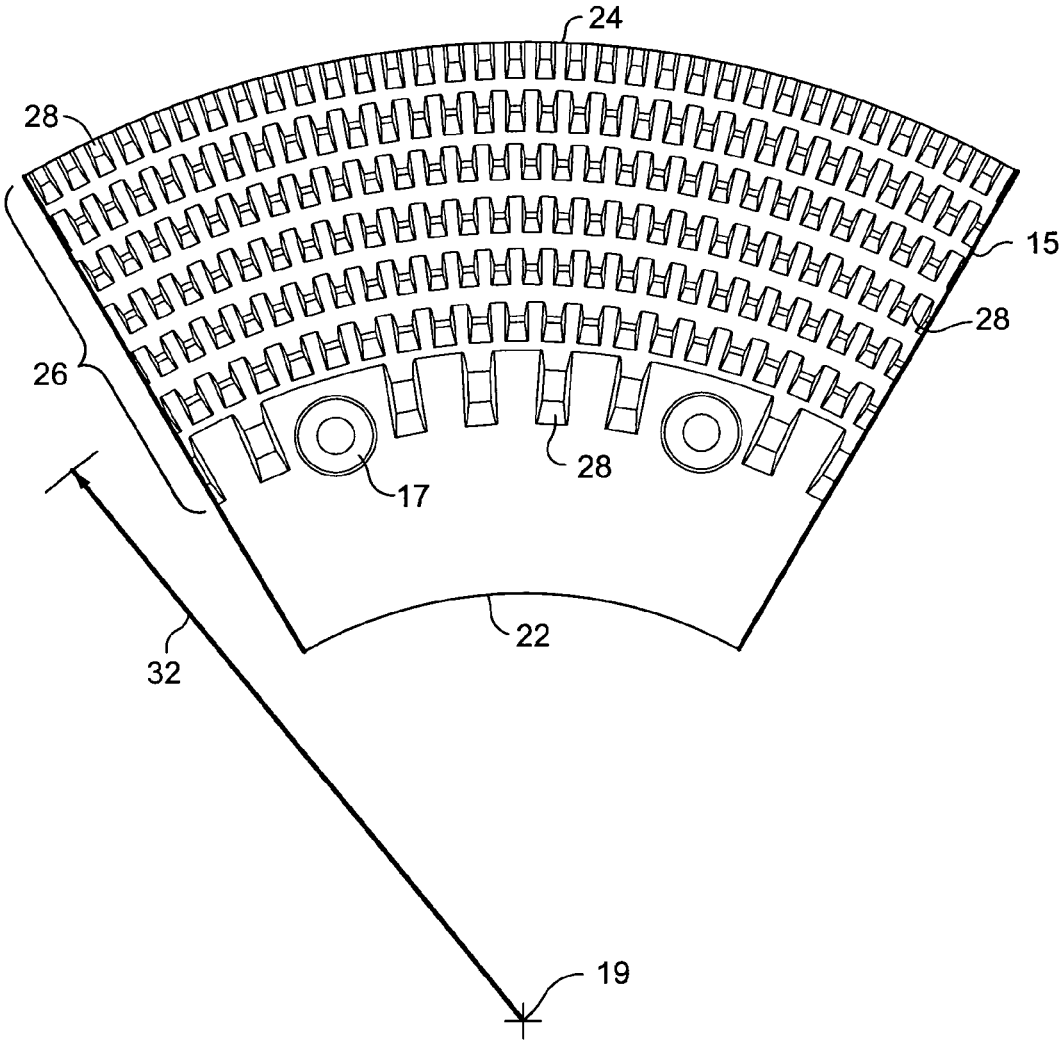
Fig. 1A (PRIOR ART)
FIGS. 1(*a*) and 1(*b*) are a front view and side view, respectively, of a pyramidal toothed plate segment conventionally used in disc-type dispergers.
Figure 1C:
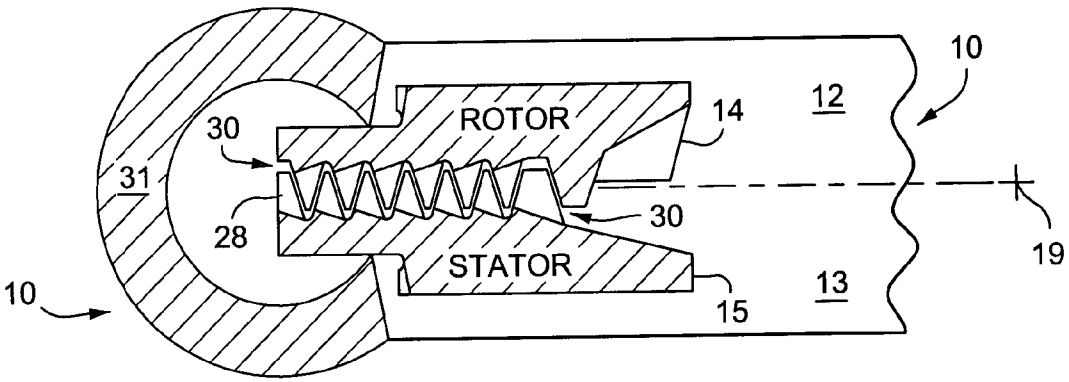
Fig. 1C (PRIOR ART)
Figure 1B:
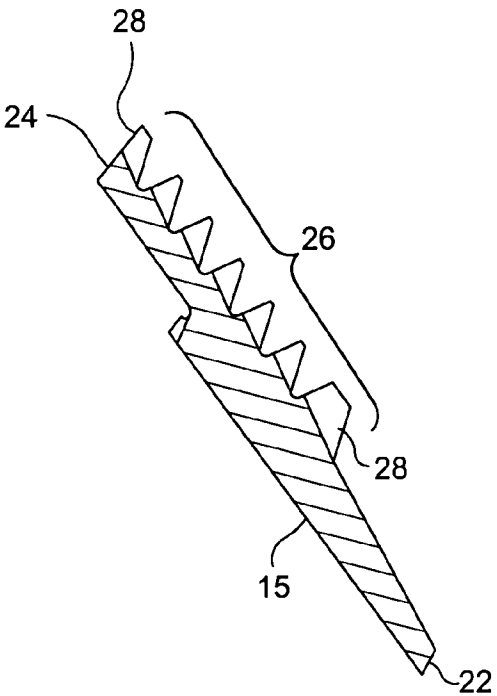
Fig. 1B (PRIOR ART)
Figure 2A:
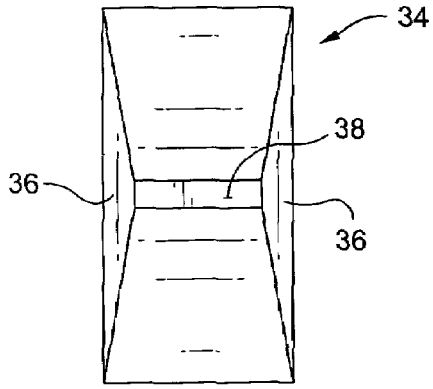
Fig. 2A (PRIOR ART)
FIGS. 2*a* and 2*b* are a top down view and a side perspective view, respectively, of a conventional tooth geometry for a disperger plate segment.
Figure 2B:
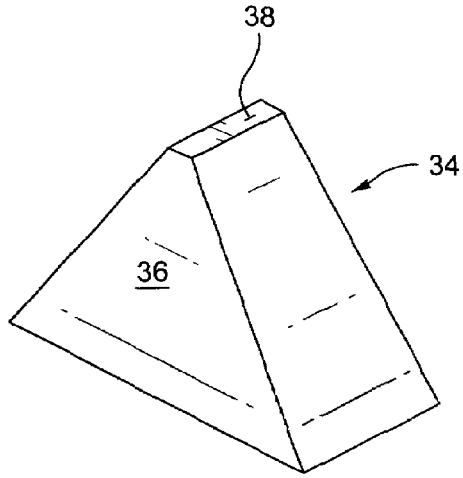
Fig. 2B (PRIOR ART)

The V-shaped angle of the leading sidewall 42 forms a concave surface facing the direction of rotation 57 on the rotor plate. The first and second sidewall surfaces 54, 56 preferably each form an angle with respect to a radial of the plate. The angles are preferably in a direction opposite to the rotation of the rotor disc. For example, the first and second sidewall surfaces 54, 56 may be each at an angle of 0° to 60° with respect to a radial 32 (FIG. 1*a*). In a preferred embodiment, the first and second 54, 56 surfaces may be each at an angle of 5° to 45° with respect to a radial. While the first and second sidewall surfaces 54, 56 may each have the same magnitude of angle, they may alternatively have different angles with respect to a radial 32. For example, the first sidewall surface 54 may form an angle of 7.5° and the second sidewall surface 56 may form an angle 35° with respect to a radial. The angle of the first surface 54 and a radial is a feeding angle.

The leading edge 60 of the corner of a disperger tooth 40 may be formed by an front edge of the first surface 54 (radially inward) and a leading edge of the front wall of 50. The angle may be less than 90° between the first surface 54 of the sidewall and the front wall 50. For example, the leading edge 60 of the tooth may have an angled of 85° to 30° , and more preferably 82.5° to 65° . The leading edge is sharp as compared to the 90° corners of traditional disperger teeth. The sharp leading corners should retain a sharp edge better as they wear, as compared to traditional 90° edges.

The second surface 56 may have an angle and length such that it deflects refiner material particle moving radially between the teeth. The deflection slows the refined material radially flowing between the teeth. Slowing refined material reduces the erosion of the leading edges of teeth because the impact against the leading edge is lessened by the slower refined material. The angle and length of the second surface 56 may be such that its length perpendicular to a radial is at least a width of the gap between the tooth and an adjacent tooth. The angle of the second surface 56 to a radial is the holdback angle. Any combination of feeding and holdback angles may be employed depending on the desired dispersing effects.

The transition 62 between the surfaces 54, 56 of the sidewall 42 of the tooth can either be a sharp corner or a radius which may have the same width as the upper surface of the tooth (as shown in FIG. 3*b*), so that the angle across the whole height of the tooth edge is constant. A smooth radius across the whole sidewall surface (collectively 54, 56 and 62) would also achieve the same overall goals of a sharp leading edge and a holdback surface, even if the angle at the leading edge is not constant.

The described rotor plate design can be used with a stator plate with a standard tooth. On the other hand, the stator plate may also have V-shaped sidewalls. The stator design may present the same sharp crossing corner angle, e.g., greater than 90°, to the process to maintain better wear characteristics. The crossing angle is from a tangent line extending in front of the tooth edge and back to the surface of the sidewall adjacent the edge. The stator plate segments may include double-angle teeth having the convex sidewalls that face the rotation, so that the angle of the tooth edge at the crossing interface would be greater than 90°. A crossing angle of greater than 90° is not perceived as a problem for stator wear, because edge rounding mostly occurs on the rotor teeth. It may be desirable to for the crossing angles of rotor and stator tooth surfaces to vary to improve disperging efficiency and feed transfer through the interface of rotor and stator teeth.

Figure 4A:
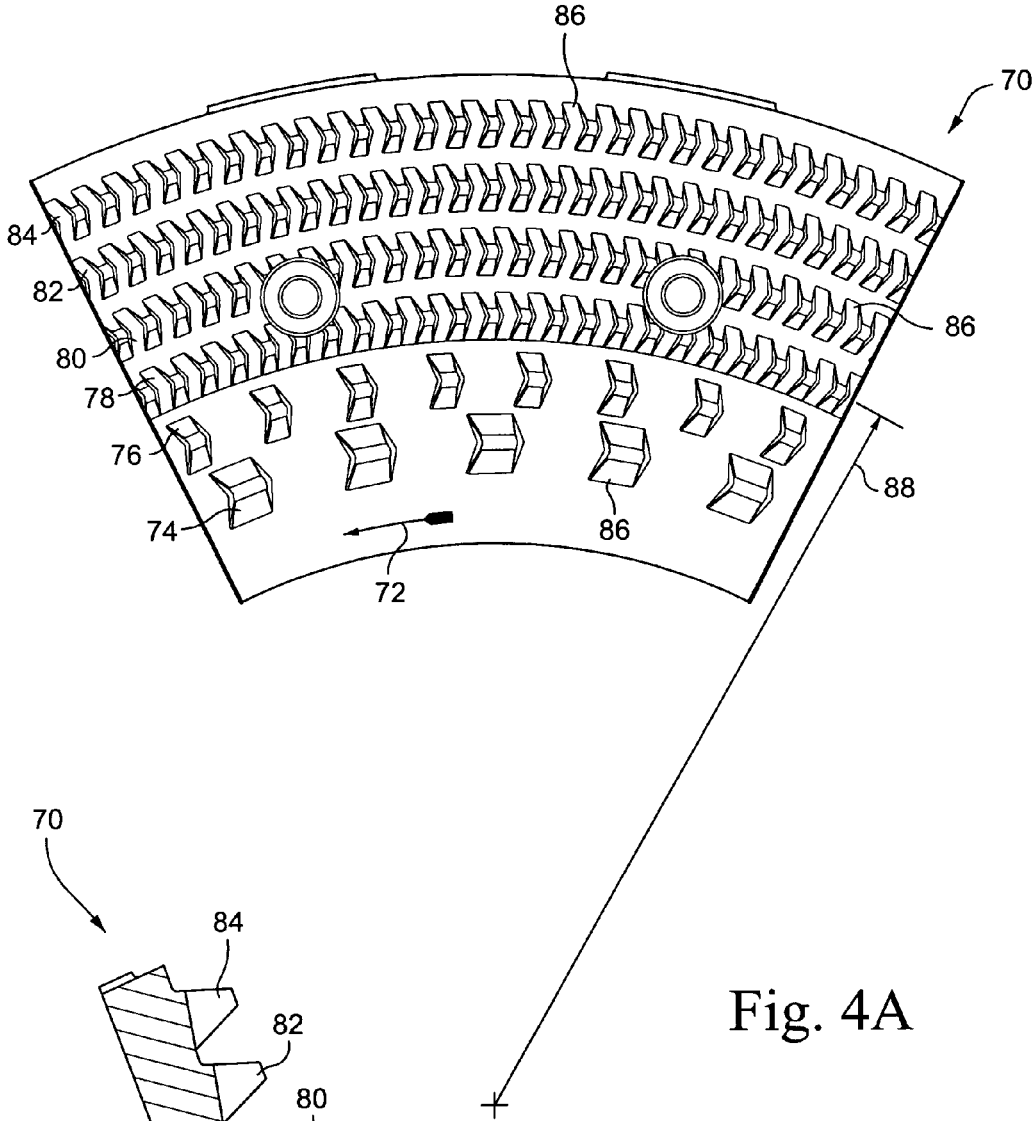
FIGS. 4*a* and 4*b* are a front plan view and a side cross-sectional view, respectively, of a disperging rotor plate segment having double angled teeth.
Figure 4B:
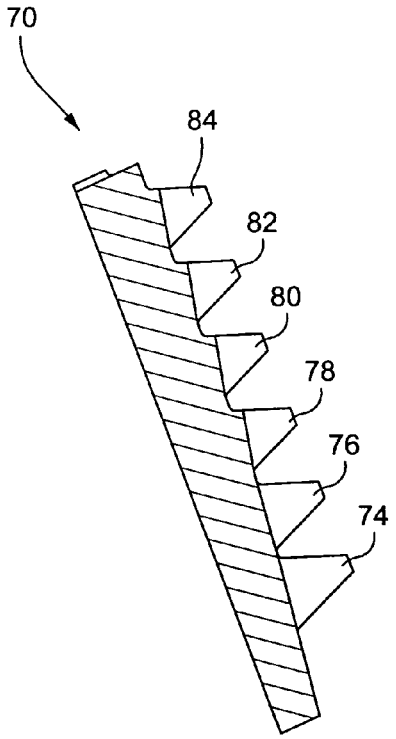

FIGS. 4*a* and 4*b* are a front plan view and a side-cross-sectional view, respectively, of an exemplary disperger rotor plate segment 70 that is to be mounted on a disc and in opposition to a stator plate. The rotational direction for the rotor plate is counter clock-wise as indicated by arrow 72.

Figure 5A:
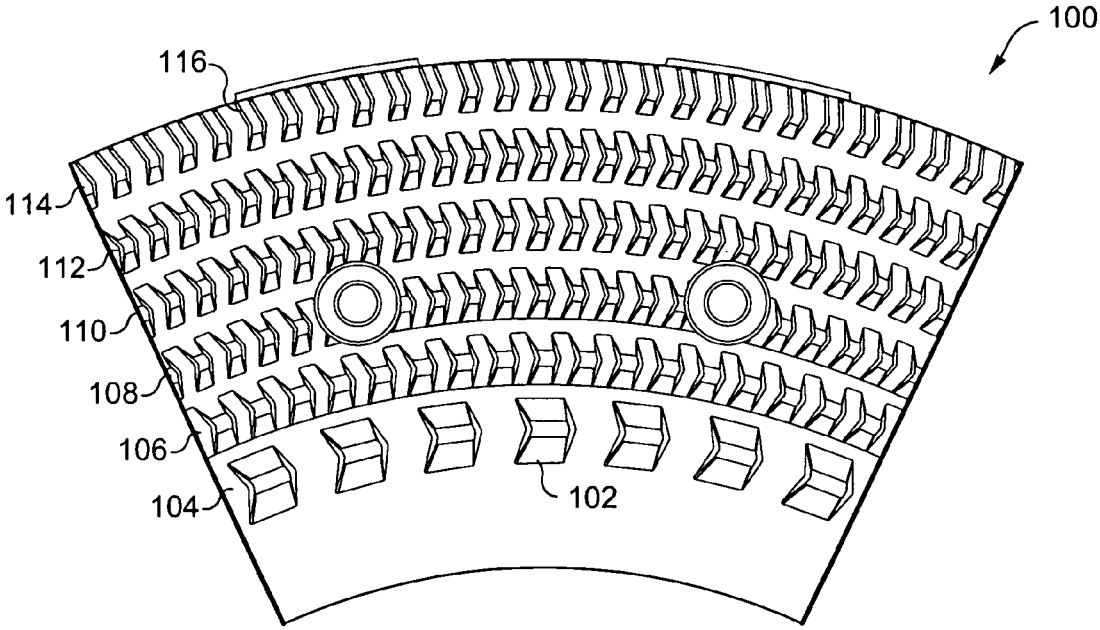
FIGS. 5*a* and 5*b* are a front plan view and a side cross-sectional view of a disperging stator plate segment having double-angled teeth.
Figure 5B:
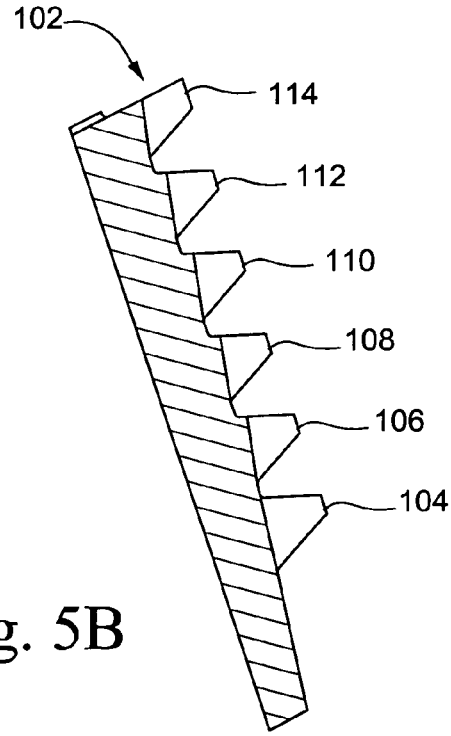

The disperger plate segment 70 includes rows 74, 76, 78, 80, 82 and 84 of teeth 86. The rows of teeth may be each at a respective radius 88 of the disc, but may also be slanted with respect to the radius. Similarly, the stator plate (FIGS. 5*a* and 5*b*) has rows of teeth that interleave with the rows of rotor teeth, when the plates are arranged in the disperger.

To promote feeding and retention of the pulp into the disperging zone, the rotor may include at least one inner row (see row 74) of disperging teeth 86. The stator is not limited to the inlet for feeding and may include disperging teeth, feeding inlets (such as the feed injectors disclosed in U.S. Pat. No. 6,402,071), breaker bars and other features. These inlet features may be selected for a particular disperger plate depending on the disperging requirements for the plate.

FIGS. 5(*a*) and 5(*b*) show a top down view and a side cross-sectional view, respectively, of an exemplary stator disperger plate segment 100 employing the double angle geometry teeth 102 arranged in rows 104, 106, 108, 110, 112 and 114. The stator disperger plate segment (when arranged in a plate) is intended to be opposite the rotor plate 70 such that the respective rows of the rotor and stator plates intermesh. The stator plate 100 includes an outermost row 114 of disperger teeth in holdback to prevent wear of the inner portion of the refiner casing. The rear wall of teeth in the outer row 114 may be perpendicular to the substrate of the plate and not tapered as is the near wall of the inner rows of teeth. The holdback angle is the angle with respect to a radial formed by the second section 116 (which is radially outward) of the sidewall of the tooth. The holdback angle may be at least as great as the holdback angle of the last row of teeth 84 on the rotor plate 60. The angles of the teeth sidewalls of the rows of the stator plate segment 100 are show as being similar to the sidewall angles for corresponding rows on the rotor plate segment 70. However, the sidewall angles on the stator plate segment need not necessarily correspond to the sidewall angles of the rows of rotor teeth.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall having a radially inward leading sidewall portion forming an exterior angle less than 180 degrees with respect to a radially outward leading sidewall portion, wherein the radially inward leading sidewall portion and the radially outward leading sidewall portion form a concave surface on the leading sidewall and the radially outward leading sidewall portion forms an acute angle with respect to a radial line extending through the leading sidewall portion, and wherein the annular rows of teeth of the refiner plate mesh with and extend between annular rows of teeth on an opposing refiner plate in a refiner.

2. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall includes a concave surface having a radially inward leading sidewall portion forming an exterior angle with respect to a radially outward leading sidewall portion, wherein the exterior angle between the radially inward leading sidewall portion and the radially outward sidewall portion is in a range of 170 degrees to 75 degrees and the radially outward leading sidewall portion forms an acute angle with respect to a radial line exending through the leading sidewall portion, and wherein the annular rows of teeth of the refiner plate mesh with and extend between annular rows of teeth on an opposing refiner plate in a refiner.

3. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall includes a concave surface having a radially inward leading sidewall portion forming an exterior angle with respect to a radially outward leading sidewall portion, wherein the exterior angle between the radially inward leading sidewall portion and the radially outward sidewall portion is in a range of 165 degrees to 90 degrees and the radially outward sidewall all portion forms an acute angle with respect to a radial line extending through the leading sidewall portion, and wherein the annular rows of teeth of the refiner plate mesh with and extend between annular rows of teeth on an opposing refiner plate in a refiner.

4. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall having a radially inward leading sidewall portion forming an angle with respect to a radially outward leading sidewall portion, wherein all portions of the leading sidewall are within an angle of zero degrees to 60 degrees with respect to a radial line of the plate, and the radially outward leading sidewall portion forms an acute angle with respect to a radial line extending through the leading sidewall portion and wherein the annular rows of teeth of the refiner plate mesh with and extend between annular rows of teeth on an opposing refiner plate in a refiner.

5. A refiner plate comprising:

a generally planar surface having annular rows of teeth arranged concentrically on the plate;

at least one of said rows includes teeth each having a leading sidewall, wherein the leading sidewall extends between a radially inward front face of the tooth and a radially outward rear face of the tooth;

the leading sidewall having a radially inward leading sidewall portion forming an exterior angle less than 180 degrees with respect to a radially outward leading sidewall portion, wherein the radially inward leading sidewall portion and the radially outward leading sidewall portion form a concave surface on the leading sidewall and the radially outward leading sidewall portion forms an acute with respect to a radial line extending through the leading sidewall portion;

the teeth each including a leading edge angle of less than 90 degrees formed between the radially inward sidewall portion and a front surface of each tooth, wherein the leading edge angle is between the radially inward leading sidewall portion and the radially inward front face, and wherein the annular rows of teeth of the refiner plate mesh with and extend between annular rows of teeth on an opposing refiner plate in a refiner.

6. A refiner plate comprising:

a generally planar surface having annular rows of teeth arranged concentrically on the plate;

at least one of said rows includes teeth each having a leading sidewall, wherein the leading sidewall extends between a radially inward front face of the tooth and a radially outward rear face of the tooth;

the leading sidewall having a radially inward leading sidewall portion forming an exterior angle less than 180 degrees with respect to a radially outward leading sidewall portion, wherein the radially inward leading sidewall portion and the radially outward leading sidewall portion form a concave surface on the leading sidewall and the radially outward leading sidewall portion forms an acute angle with respect to a radial line extending through the leading sidewall portion and;

at least one tooth having an interior angle less than 90 degrees between the leading sidewall and the front face, and wherein the annular rows of teeth of the refiner plate mesh with and extend between annular rows of teeth on an opposing refiner plate in a refiner.

7. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall including a concave surface having a radially inward leading sidewall portion forming an exterior angle with respect to a radially outward leading sidewall portion, wherein a trailing sidewall of each tooth in said at least one of said rows have a convex profile, and wherein the annular rows of teeth of the refiner plate mesh with and extend between annular rows of teeth on an opposing refiner plate in a refiner.

8. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall having concave surface include a radially inward leading sidewall portion forming an exterior angle of less than 180 degrees with respect to a radially outward leading sidewall portion, wherein the radially inward leading sidewall portion and the radially leading outward sidewall portion form a V-shape and the radially outward sidewall portion forms an acute angle with respect to a radial line extending through an apex of the V-shape, and wherein the annular rows of teeth of the refiner plate mesh with and extend between annular rows of teeth on an opposing refiner plate in a refiner.

9. The refiner plate of claim 8 wherein the radially inward leading sidewall portion and the radially outward leading sidewall portion are included in a gradually curved leading sidewall surface.

10. The refiner plate of claim 8 wherein said teeth further comprise a trailing sidewall having a surface shape complementary to the leading sidewall.

11. The refiner plate of claim 10 wherein the trailing sidewall of the tooth and the leading sidewall of an adjacent tooth form a substantially constant gap therebetween.

12. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall having a radially inward leading sidewall portion forming an angle with respect to a radially outward leading sidewall portion, wherein the leading sidewall has a concave profile and a trailing sidewall of each tooth in said at least one of said rows has a convex profile, and wherein the annular rows of teeth of the refiner plate mesh with and extend between annular rows of teeth on an opposing refiner plate in a refiner.

13. A refiner plate comprising:

a generally planar surface having annular rows of teeth arranged concentrically on the plate, and at least one of said rows includes teeth each having a leading sidewall, wherein the leading sidewall extends between a radially inward front face of the tooth and a radially outward rear face of the tooth;

the leading sidewall having a radially inward leading sidewall portion forming an exterior angle with respect to a radially outward leading sidewall portion, wherein the leading sidewall has a concave profile, and the radially outward leading sidewall portion forms an acute angle with respect to a radial line extending through the leading sidewall portion and wherein the annular rows of teeth of the refiner plate mesh with and extend between annular rows of teeth on an opposing refiner plate in a refiner.

14. A refiner plate comprising:

annular rows of teeth wherein the rows are concentrically arranged;

the teeth, in at least one of said rows, each include a leading edge facing a rotational direction of the plate or of another plate rotating with respect to the plate, and the leading edge forms an angle in a range of 5 degrees to 60 degrees between a leading sidewall of each of the teeth and a front face of each of the teeth, wherein the leading sidewall extends between a radially inward front surface of each of the teeth and a radially outward read surface of each of the teeth;

the leading sidewall having a radially inward leading sidewall portion forming an angle with respect to a radially outward leading sidewall portion, wherein the leading sidewall has a concave profile and the radially outward leading sidewall portion forms an acute angle with respect to a radial line extending through the leading sidewall portion and wherein the annular rows of teeth of the refiner plate mesh with and extend between annular rows of teeth on an opposing refiner plate in a refiner.

15. The refiner plate of claim 14 wherein said teeth, in said at least one row, further comprises a trailing sidewall having a surface shape complementary to leading sidewall.

16. The refiner plate of claim 15 wherein the trailing sidewall and an opposing leading sidewall of an adjacent tooth form a substantially constant gap therebetween, wherein the adjacent tooth is in the at least one of said rows.

17. A refiner plate comprising:

annular rows of teeth wherein the rows are concentrically arranged;

the teeth, in at least one of said rows, each include a leading edge facing a rotational direction of the plate or of another plate rotating with respect to the plate, and the leading edge forms an angle in a range of 5 degrees to 60 degrees between a leading sidewall of each of the teeth and a front face of each of the teeth, wherein the leading sidewall extends between a radially inward front surface of each of the teeth and a radially outward read surface of each of the teeth;

wherein the annular rows of teeth of the refiner plate mesh with and extend between annular rows of teeth on an opposing refiner plate in a refiner, and wherein, in the teeth in at least one of said rows, a leading sidewall including a V-shape having a radially inner leading sidewall section with the leading edge and a radially outward leading sidewall section slanted with respect to a radial of the disc in a direction opposing the disc rotation and the radially outward leading sidewall portion forms an acute angle with respect to a radial line extending through an apex of the V-shape.

18. The refiner plate of claim 17 wherein the V-shape includes an angle in a range of 170 degrees to 75 degrees between the inner section and the outward section of the sidewall.

19. The refiner plate of claim 17 wherein the V-shape includes an angle in a range of 165 degrees to 90 degrees between the inner section and the outward section of the sidewall.

* * * * *